United States Patent [19]

Mertens

[11] Patent Number: 4,619,369

[45] Date of Patent: Oct. 28, 1986

[54] SUPPORT OR STABILIZER DEVICES FOR MOBILE CONSTRUCTION EQUIPMENT

[75] Inventor: Heinz Mertens, Hamm, Fed. Rep. of Germany

[73] Assignee: Maschinenfabrik Walter Scheele GmbH & Co. KG, Unna-Massen, Fed. Rep. of Germany

[21] Appl. No.: 710,857

[22] Filed: Mar. 12, 1985

[30] Foreign Application Priority Data

Mar. 15, 1984 [DE] Fed. Rep. of Germany ..... 3409476

[51] Int. Cl.[4] ..... B66C 15/00

[52] U.S. Cl. ..... 212/189

[58] Field of Search ..... 212/189; 254/86 R, 103; 280/766

[56] References Cited

U.S. PATENT DOCUMENTS 2,375,264 5/1945 Wagner et al. ..... 212/189
4,118,054 10/1978 Vigerie ..... 212/189
4,386,711 6/1983 Gattu et al. ..... 212/189

FOREIGN PATENT DOCUMENTS 2509708 1/1983 France ..... 212/189
965975 10/1982 U.S.S.R. ..... 212/189

*Primary Examiner*—Trygve M. Blix
*Assistant Examiner*—Stephen P. Avila
*Attorney, Agent, or Firm*—Karl F. Ross; Herbert Dubno

[57] ABSTRACT

Stabilizers especially intended for mobile heavy equipment such as concrete delivery vehicles, mobile cranes and like vehicles are pivotally associated with the respective equipment and are downwardly pendent. For driving the vehicle, telescoping stabilizer legs can be moved clear of the ground by respective piston-cylinder units. In their operating condition, when the vehicle is parked, they stabilize the equipment and vehicle on the ground. The respective legs are connected at the frame in such a way that they can be swung into a substantially horizontal position when the vehicle is driven to another location.

7 Claims, 3 Drawing Figures

SUPPORT OR STABILIZER DEVICES FOR MOBILE CONSTRUCTION EQUIPMENT

FIELD OF THE INVENTION

My present invention relates to support devices for mobile construction equipment, for example mobile concrete pumps, mobile cranes, and like equipment upon which a boom, framework, pylon or like structure may be swung beyond the center of gravity of the chassis.

BACKGROUND OF THE INVENTION

Mobile heavy construction equipment of the aforementioned type can include one or more telescoping support members on struts which can be used to brace, support and similarly stabilize the vehicle body and/or frame with the specific apparatus for carrying out such operations as pumping concrete through an arm or a boom, crane movements, and the like while the vehicle or unit is standing. The stabilizer or support member or members are disposed substantially in vertical attitude while in their supporting role. The member or members are drawn clear of the ground when the unit is to be driven from one location to the next.

It is generally known to support the lower chassis or carriage, or similar portions of such vehicles, for mobile equipment when in the parked condition for performing the specific purpose of the unit at a given location. Such support has been afforded by way of extensible and retractable support arms or outriggers which are arranged laterally of the chassis and/or at corner points or at the rear and which have at their free ends vertically and downwardly extending support or base elements forming support feet which can be extended and retracted by means of piston-cylinder assemblies. These base elements provide the positional stability required for such heavy equipment.

When in the hitherto known mobile or vehicular equipment the support arms are swung in toward the chassis for travel of the vehicle space must be provided to accommodate the downwardly extending but lifted feet. This poses a problem because the rearwardly disposed carrier or support arms with their vertically and downwardly extending base elements can reach into the operating region of the rear axles and/or rear wheels so that a vehicle with rather large wheel-to-wheel distances must be used as the basic unit for the mobile equipment. This poses a handicap in many instances.

OBJECTS OF THE INVENTION

It is therefore the principal object of the invention to provide improved mobile construction equipment with stabilizer means which substantially preclude disadvantages of hitherto known mobile heavy equipment.

It is also an object of my invention to provide support devices which can be manufactured in a standard manner for a wide range of wheel-to-wheel distances in mobile equipment.

It is further an object of my invention to provide support devices especially for mobile boom equipment which requires less concern with the wheel-to-wheel distances in the mobile equipment.

SUMMARY OF THE INVENTION

These objects are attained in accordance with the invention by providing a boom-type construction machine with at least one and preferably a plurality of supports or stabilizers specifically telescoping legs, connected to a support frame of the mobile equipment so that at least one leg, or at least one pair of such legs, can be swung into a substantially horizontal position when desired, for example when the vehicle is driven from one location to the next.

According to a feature of the invention, the or each support can include a support leg or similar member which is linked to an adjustable or movable (preferably extensible) carrier or support arm (outrigger), and a piston-cylinder unit also linked to the carrier or support arm.

It is also preferred that at least one piston-cylinder unit and the associated support leg or member be coupled to one another in a unitary and cooperating assembly by being coordinated, linked and/or connected at four points (i.e. to form a four-point linkage). These four points can be respectively arranged in certain patterns, for example in the manner of a parallelogram. Accordingly, the configuration can be referred to as a four-point linkage assembly. A three-point pivot linkage, in which one leg of the triangle thus formed may be extensible, can also be used with advantage.

Thus, in one condition, for example when the piston-cylinder unit is actuated, i.e. when the piston rod is retracted, the respective support leg or member can be moved between a horizontal rest position, for travel of the vehicle, and an upright or vertical operating position, for example when the vehicle is parked or standing.

Also, a piston-cylinder unit can be swung or pivoted about its axis or center of rotation. This center forms the first point of the four-point or three-point linkage. This first point can be at the mounting end of the respective cylinder. The second point of the linkage assembly or configuration is provided at the end of the telescoping support member which is near the mounting end of the respective cylinder. This second point will be at a fixed distance from the first point of the linkage. The further main point or points of the three-point or four-point linkage are positioned at a variable distance from the mentioned first and second points.

Thus, the respective support member or leg can be swung between a horizontal rest position, i.e. when driving the vehicle, and a vertical operating position or condition, i.e. for a supporting, bracing, or similar mode which enhances the stability of the piece of equipment during the specific task, for example delivering concrete or load-moving work requiring a crane.

The support leg or member can be connected in the vicinity of its linkage point, i.e. the second point of the three or four-point linkage, at its respective carrier or support arm by way of a triangular connecting plate. Furthermore, the respective support member or leg can be telescopically extended and, preferably has a holding bore or similar passage which can receive a lock element, for example a lock pin, which will prevent telescoping movements from occurring, i.e. the longitudinal extension of the support leg or member, when a lock element (e.g. the pin) is introduced into the bore.

By pinning the connecting plate at and/or to an associated carrier or support arm via the lock pin, a very precise alignment and positioning of such support leg or member is afforded. On the other hand, when the connecting plate is unlocked, i.e. when the pin is removed and introduced into the holding bore of the telescoping support member or leg, actuation of the piston-cylinder unit affords swinging of the support leg into the horizontal rest position.

In accordance with a further preferred embodiment, a single pin serves for locking the connecting plate and as the lock pin for the holding bore in the telescoping leg.

BRIEF DESCRIPTION OF THE DRAWING

The above and other objects, features and advantages will become apparent from the following description, reference being made to the accompanying drawing, in which.

SPECIFIC DESCRIPTION

Figure 1:
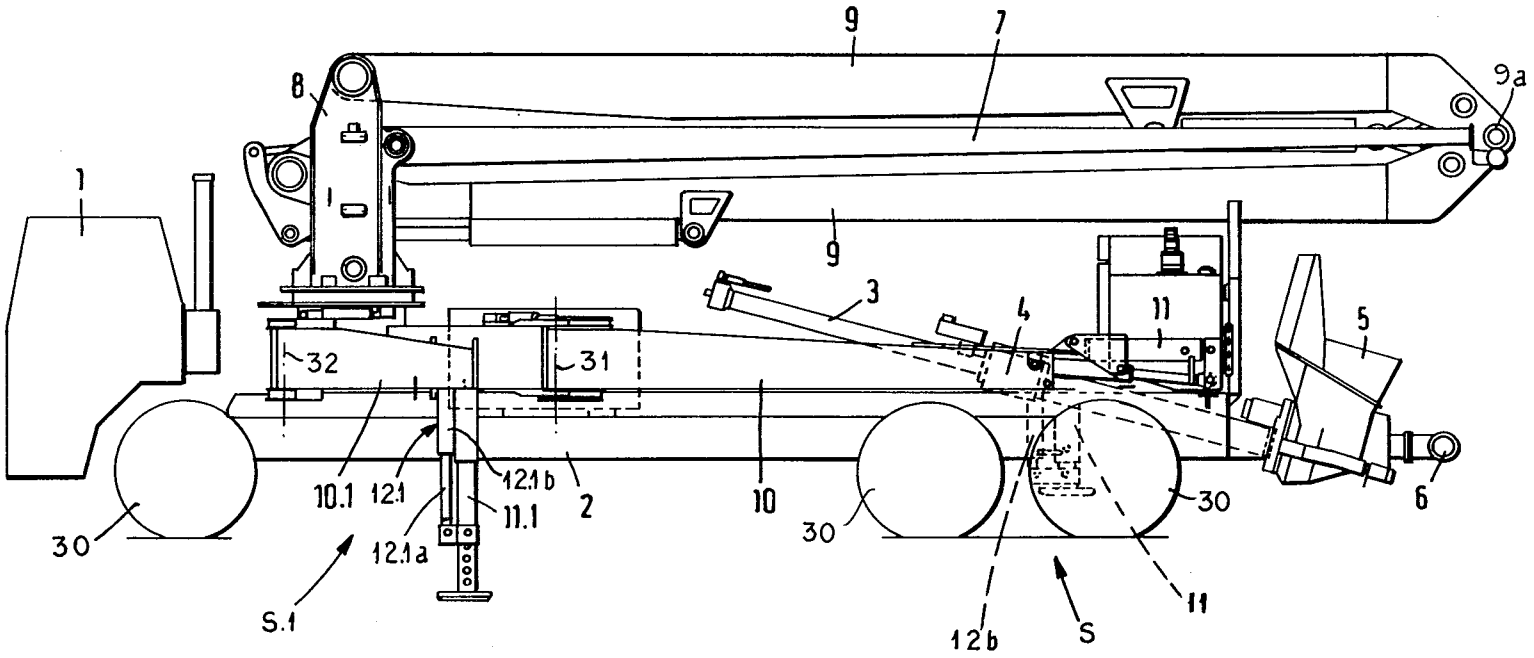
FIG. 1 is a side elevational view of a concrete pumper of the snorkel type embodying the invention.

FIG. 1 shows a complete concrete pumping vehicle. While the invention is described with reference to such a concrete truck or vehicle, other similar applications are fully within the scope of the invention, such as mobile cranes, mobile work platforms, vehicles for digging-up large trees, drills for drilling (coring) for coal, oil, etc., and other such application wherein boom-equipped machinery requires outrigger stabilizers.

The vehicle in FIG. 1 includes a cab 1 or similar structure which houses the engine or motor for the provision of motive power at least to the rear wheels 30 which are mounted on the chassis 2 as is known.

In this specification the term "forward" and similar references to location will mean forward in the direction of travel of the cab and rearward will mean, accordingly, the direction away from the cab in the direction opposite to the direction of travel of the cab.

The frame 2 provides the base for an apparatus for pumping and distributing fluid concrete or the like material. This pump apparatus is schematically represented by a piston-cylinder unit 3 (representing a tandem pump) which is governed by a control unit 4.

Thus, the piston pump operates in the manner of a tandem pump, and this can carry out at least two strokes, namely a suction stroke and a pressure stroke. During a suction stroke, concrete is moved, sucked as it were, from a receiving and/or feed or delivery hopper 5, and concrete is displaced under pressure during a subsequent pressure stroke into a concrete conveying conduit. Accordingly, in conformity with the tandem pump concept, respective columns of concrete are sequentially forced out of respective cylinders.

The concrete conveying conduit or duct is comprised of a pressure duct or conduit 6 and a plurality of conveyer ducts or conduits 7.

The conveying conduit extends through a rotary tower structure 8. Also, this duct for conveying concrete is generally supported by at least two arms 9 of this structure, pivotally connected at 9*a* and which are swingable upwardly and outwardly for delivering the concrete through the distributor mast. Accordingly, the conveyer conduit serves to bring the concrete to the desired installation location by the respective pumping action. Further details of the arrangement and operation of the arms 9 may be obtained by reference to the commonly assigned co-pending application Ser. No. 711,975.

It is also of note in the context of this invention that several forward carrier or support arms 10.1, usually a pair, and several rearward carrier or support arms 10, usually a pair on each side of the vehicle, are connected to the base frame 2. The outrigger arms 10.1 and 10 can respectively be swung out and/or away from the base frame 2, i.e. pivoted, swung or rotated with respect to the associated pivot axes 31 and 32. As required, the arms 10.1 and 10 can respectively be telescopically extended.

Each arm 10.1 carries at its free end a telescopically extensible support or stabilizing leg, member or foot 11.1, and each arm 10 carries at its free end a telescopically extensible support or stabilizing leg, member, or foot 11. Each support leg 11.1 is associated with a piston-cylinder unit 12.1, and each support leg 11 is associated with a piston-cylinder unit 12. The piston-cylinder unit 12.1 typically includes a piston 12.1*a* and a cylinder 12.1*b*. Correspondingly, the piston-cylinder unit 12 typically includes a piston 12*a* and a cylinder 12*b*.

Accordingly, when the truck is to be driven, the carrier or support arms 10 and 10.1 are retracted or swung against the base frame 2 as closely as possible. As well, the associated support legs 11 and 11.1 are brought into a rest position. This means that the support leg 11.1 has been swung as closely as possible against the base frame 2, and the piston 12*a* of the piston-cylinder unit 12 is fully extended.

Figure 2:
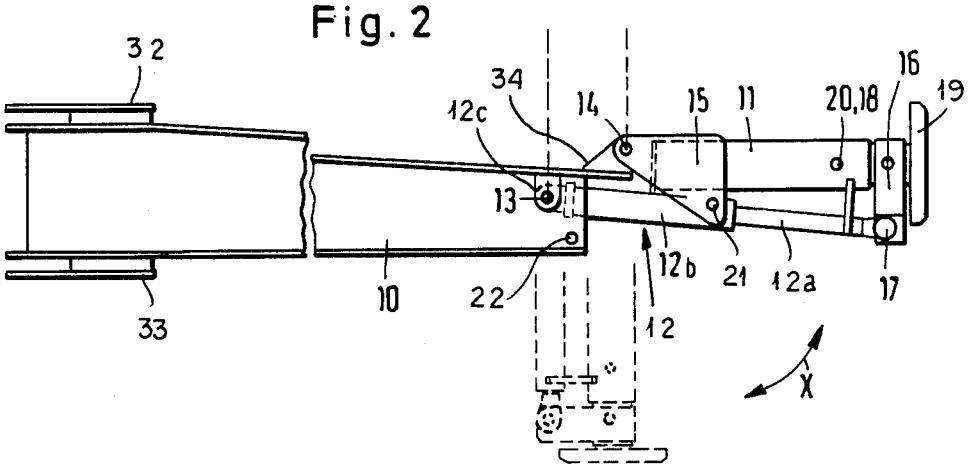
FIG. 2 is a side elevational view showing in greater detail the attachment of the rearward stabilizer leg at its carrier arm and the associated piston-cylinder unit for moving the stabilizer leg, the stabilizer leg being represented in solid lines in the horizontal rest position and in dash outline in an intermediate position prior to attaining its stabilizing or support mode.

The rearward support leg 11, in turn, is elevated to be clear of the ground by a corresponding retraction of the associated piston 12*a*, compare the dash outline in FIG. 1, and is then swung into its horizontal rest position as is indicated in solid outline of the respective components in FIGS. 1 and 2, whereby the piston 12*a* is extended as is most clearly shown in FIG. 2.

For the respective operating condition or position, the carrier or support arms 10 and 10.1 are extended or swung away from the base frame 2 when the piece of equipment is in the operative condition, for example when concrete is to be delivered at a given location. Next, the support legs 11 and 11.1 are swung into upright position and extended, and the undercarriage or base frame 2, i.e. the piece of equipment in toto, is afforded its required stability while standing.

The support device S.1 in the forward region, i.e. in the region disposed beneath the cab 1 of the frame 2 is laterally allowed sufficient space and here generally a folding arrangement or device in accordance with one aspect of the invention will be superfluous. This is correspondingly shown in FIG. 1. Accordingly, the forward support member or leg 11.1 and its associated piston-cylinder unit 12.1 can be fixedly arranged at end of the outrigger 10.1.

It will be obvious, hwever, that a pivotal or swinging mounting of the arm 10.1 and a corresponding piston-cylinder unit for this purpose is also within the scope of this invention.

The rearward leg 11, or a pair of legs and the associated piston-cylinder assembly 12 are mounted to be swingable or pivotal as has been mentioned. Thus, the carrier or support arm 10 per se is pivotally or swingably arranged or mounted with respect to the axis or center of rotation 31 near the mast or tower 8. The arm 10 has a corresponding length to extend towards the rearward end of the frame 2. At the rearward end of the arm 10 is arranged the stabilizing or support device S in accordance with the invention.

In accordance with FIG. 1 and in consideration of the fact that the vehicle is in the drive condition, the respective leg 11 is shown in its rest position, i.e. in a respective horizontal attitude near the rearward end of base frame 2. In dash outline an intermediate position can be seen. When in this intermediate condition, the leg 11 can be telescopically extended in downward direction to assume the operating position.

Additional inventive features will be described further with reference to FIGS. 2 and 3.

Thus FIG. 2 shows the rearward support device S in solid lines and in the horizontal rest position according to FIG. 1. The base and support element is the carrier or support arm 10. As mentioned, this carrier arm 10 is swingable or pivotally mounted, with respect to the axis 31, between holding elements 33*a* and 33*b*, and the respective turning or swinging movement is about the vertically disposed axis of rotation 31. The arm 10 can have I-beam, wide-flange or other structural-shape configuration when viewed in cross section, and can taper from the axis of rotation 31 towards the free end at which the leg 11 is mounted. As required, the arm 10 can be telescopically extensible.

The leg 11 is a generally cylindrical and telescopically extensible element, for example comprised of an outer pipe which is connected to a bracket 34 or similar clevis assembly atop the free end of arm 10. A second pipe or solid rod is arranged within the outer pipe and the second or inner pipe or rod is telescopically or reciprocatingly movable for achieving the respectively required distance as is indicated schematically in dash outline in FIG. 3 by the arrow Y.

A base member or control unit 19 provides the lower and adjustable terminus for the support S.

Figure 3:
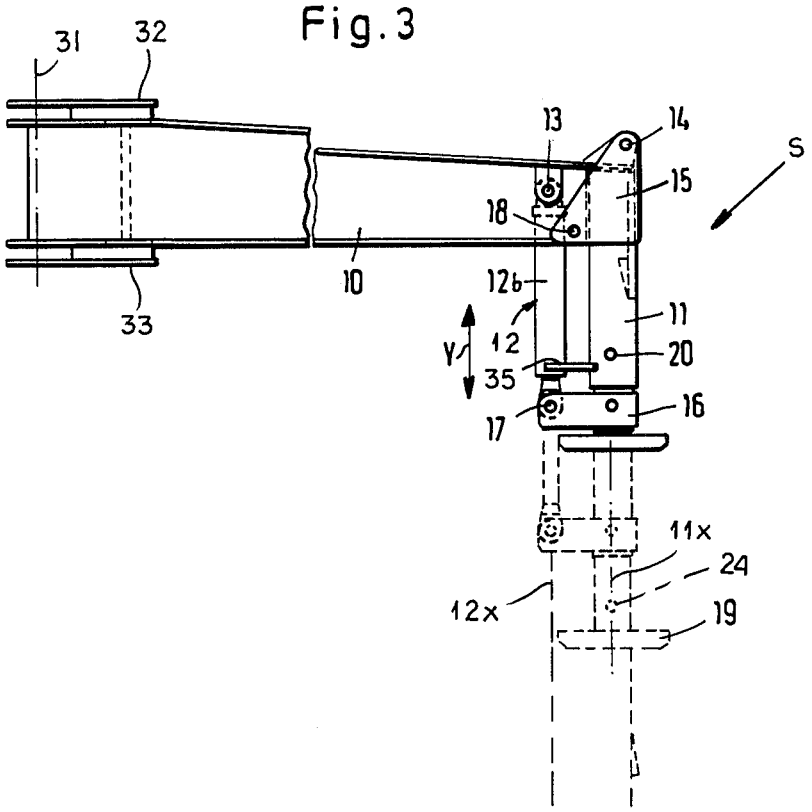
FIG. 3 is a view similar to FIG. 2 with the stabilizer leg shown in solid lines just prior to its being telescopically extended into its operating position, with the operating position or condition being indicated in dash outline.

When viewing the various elements shown in FIG.3, the longitudinal central axis 12*x* of the piston-cylinder unit 12 extends parallel to the longitudinal axis 11*x* of the leg 11. Thus, there are four points, namely 14 and 20 for a leg 11, and 13 and 17 for a piston-cylinder unit 12. In the shown position these points are the corners of a so-called four-corner or four-point linkage, for example a parallelogram as is suggested in FIG. 3, whereby the major or longitudinal sides are respectively provided by the central axis 11*x* of the leg 11 and the longitudinal central axis 12*x* of the piston-cylinder unit 12.

Actuation of the piston-cylinder unit 12, i.e. extending the piston 12*a*, accordingly, will cause swinging of the leg 11 due to base plate 16 and/or the bracket or guide providing the respective connection between and at the respective ends of the piston-cylinder unit 12 and the leg 11. The swinging movement will be through an arc generally indicated by the curved arrow X in FIG. 2. Note that when plate 16 is rigid with the outer sleeve of leg 11, the four-point linkage is equivalent to a three-point linkage.

In summary, the four-point linkage is configured as follows:

The piston-cylinder unit 12 is pivotally or swingably connected to the support or carrier arm 10, for example by way of a bracket or similar member 12*c* at the base of the cylinder 12*b*. A cooperating guide element 35 is secured at least for guiding purposes near the other end of the cylinder 12*b*. The respective connection of the piston-cylinder unit 12 is such that the point or axis 13 can be considered an axis or center of rotation, and the arrow Y in FIG. 2 is representative of the arcuate motion. Accordingly, the axis 13 will include a respective short shaft or similar member.

A similar second center or axis of rotation is provided at 14 near the first center or axis 13, but this second center or axis 14 is disposed further towards the end of the support or carrier arm 10, specifically in the bracket 34, whereby this second center or axis is generally arranged above the first center or axis of rotation 13. This center or axis 14 includes a clevis or similar bracket and a respective shaft at the mounting base of the telescoping leg 11. Thus, the telescoping leg 11 can swing, rotate or turn about the second axis or center of rotation 14, as dictated by the piston-cylinder unit 12.

A lock or connecting plate 15 of triangular configuration is fixedly connected near this center or axis 14, and a base member or end plate or similar connector 16 is provided at the free end of the telescoping leg 11 which is away from the pivot or first end thereof. The connector 16 is generally connected to the inner pipe of the leg 11, or it forms part of this telescopically extensible element. Accordingly, since it is connected to the piston 12*a* at 17, the connector 16 will move correspondingly, as required due to actuation of the piston-cylinder unit 12, as will be described in detail below.

The connector 16 extends laterally and inwardly, i.e. in the direction towards the cab 1, and its respective end is connected at the third point 17 in a hinge-like or movable-joint manner to the free piston end of piston 12*a*, i.e. the piston end which extends from the cylinder 12*b* of the piston-cylinder unit 12.

When the piston 12*a* is in the fully retracted position as is indicated in solid lines in FIG. 3, due to the respective geometrical coordination and the associated movement-kinematic, the leg 11 and the connector 16 have been moved or swung from the horizontal position shown in solid lines in FIG. 2, about the axis or center of rotation 14 and/or 13, into the downwardly directed or pending condition. Thus, the telescoping leg 11 can be moved from a horizontal or rest position, into a vertical position, and into operating position. In FIG. 3 this vertical and extended position is shown in dash outline.

FIG. 3 shows the initial or fixed position, i.e. prior to extending the piston 12*a*. In this condition, the leg 11 and the piston-cylinder unit 12 are pending vertically in downward direction from the respective centers or points 13 and 14. Actuation or extension of the piston 12*a* will then telescopically extend the leg 11 and the connector 16 is moved in tandem with it.

Relative fixing of the components is achieved by introduction of a lock pin or similar member 18 such that the connector plate 15, which is rigidly or fast secured to the leg 11, is pinned to the arm 10. As mentioned, the lock plate 15 is generally of triangular configuration and one corner thereof, in the operating position of the support S, extends into the region between the support leg 11 and the piston-cylinder unit 12. The lock pin 18 is passed through a respective bore 21 or similar passage in this corner of the connecting plate 15 and a matching bore 22 in the support or carrier arm 10, and the leg 11 is precluded from being swung with respect to its point 14.

The four-point linkage assembly is then generally rigid and movement of the piston 12*a* will cause a correspondingly linear and telescoping movement of the connector 16 out of the leg 11, i.e. when this connector forms such a telescoping element of the leg 11. This linear motion is represented by the arrow Y. The piston 12*a* will be extended until the base member 19 is firmly positioned on the ground.

As has been mentioned, the base member 19 is secured at the leg 11, and/or the connector 16. This base member 19 is concentric with respect to leg 11 and it can be adjusted by way of a passage or bore 23 and an associated pin or similar lock member for fixing the relative position.

Reference is furthermore made to the change from the operating condition or position shown in FIG. 3, to the rest position or condition shown in FIG. 2. In the operating position, the four-point linkage, as mentioned, is substantially fixed or rigid, and the axes 11*x* and 12*x* are then substantially parallel. For the change into the horizontal rest position, the pin 18 is removed and inserted into the arresting or holding bore 20 in the leg 11. As mentioned, bore 20 may be considered a point of the four-point linkage assembly. Only when the pin 18 has been installed in bore 20, i.e. when pin 18 is not located in the bore 21 of plate 15 and bore 22 of arm 10, can the leg 11 be pivoted or swung about the center 14 upon actuation of the piston 12*a* of the piston-cylinder unit 12.

In the final analysis it is possible with the present invention to manufacture in standard series support leg constructions for any desired wheel-to-wheel distances, because one can neglect different wheel-to-wheel distances.

I claim:

1. A mobile boom-type construction machine comprising:

a base frame, said base frame being provided with wheels for travel of said machine;

a plurality of support legs connected to said frame with each one of said plurality of support legs being telescopically extensible with reference to the respective longitudinal and central axis thereof, and being adapted to extend in a downwardly directed attitude from said base frame at least one of said support legs being formed with a holding bore;

means for mounting each of said support legs to said frame such that it can be moved from an erect first position in which it serves to stabilize the frame for a particular operating function of the machine, into a substantially horizontal second position in which it is at rest and substantially clear of the ground and during which the machine can be driven to a different location;

for each one of said plurality of support legs at least one piston-cylinder unit to effect said movement from said first position to said second position;

for at least one support leg, an extensible carrier arm swingably mounted on said base frame and having a fixed opening for receiving a respective lock member; means for pivotally mounting said carrier arm such that the associated support leg can be swung with respect to said base frame;

a first means for pivotally connected the associated support leg to said carrier arm, said first means forming a first point of reference, and said first means allowing turning movements of the associated support leg with respect to said first point, and wherein said associated support leg is telescopically extensible in length with reference to said first point along its longitudinal central axis;

a second means for pivotally connecting the respective piston-cylinder unit to said carrier arm said second means forming a second point of reference, and said second means allowing turning movements of said piston-cylinder unit with respect to said second point, whereby said first point and said second point are spaced from each other by a fixed distance;

at least one connector for connecting it and the respective free piston end at a third point of reference which is remote from said first point but located on said longitudinal and central axis of said piston-cylinder unit, whereby an actuation of said piston-cylinder unit said connector is adapted to move said at least one support leg between its rest position and its operating position, said connector being secured to the respective support leg in such a way as to be capable of being moved with said associated support leg during a respective telescoping extension movement thereof;

a connecting plate secured to the pivotally mounted support leg at least near said second point, said connecting plate having an opening which is in alignment with said opening of said carrier arm at least when said support leg is in its operating position; and a lock pin insertable in said opening of said connecting plate and in said opening of said carrier arm for connecting said connecting plate to said carrier arm and for preventing swinging movement of said piston cylinder unit with respect to said first point, but allowing a precise alignment and guiding of said support leg, said lock pin being removable from said openings of said connecting plate and carrier arm for releasing said plate to allow respective swinging movements of said support leg and said piston-cylinder unit with respect to said first point and said second point as aforesaid on actuation of said piston-cylinder unit, said lock pin being adapted to be inserted into said fixed opening of said support leg for preventing the telescoping extension thereof.

2. The machine according to claim 1 wherein said connecting plate is of triangular configuration.

3. The machine according to claim 1 wherein said connector is a base unit with at least one plate.

4. The machine according to claim 1 wherein said means for pivotally mounting said carrier arm includes a pair of holding elements and a pivot shaft journaled at said holding elements.

5. The machine according to claim 1 wherein said first and second means include a clevis-and bracket assembly.

6. The machine according to claim 1 wherein at least one carrier arm is telescopically extensible.

7. Truck-mounted stabilizer device apparatus, comprising:

a base frame, said base frame being adapted to form part of a truck;

a plurality of first support legs connected to said base frame, with each first support leg being at least telescopically extensible with reference to the respective longitudinal and central axis thereof, and being adapted to extend in downwardly directed attitude from said base frame;

for each first support leg at least one piston-cylinder unit to effect respective movements thereof, each piston-cylinder unit including a longitudinal piston having a first end and a second free end remote from said first end, and each piston-cylinder unit including a longitudinal cylinder, with said first piston end being operatively connected to said longitudinal cylinder, and wherein the longitudinal and central axes of said piston and said cylinder extend substantially coaxially with respect to one another to form a piston-cylinder longitudinal and central axis;

for each first support leg at least one carrier arm pivotally mounted such that the associated first support leg can be swung with respect to said base frame;

a plurality of second support legs connected to said base frame, with each one of said second support legs being at least telescopically extensible with reference to the respective longitudinal and central axis thereof, and being adapted to extend in downwardly directed attitude from said base frame;

for each second support leg at least one piston-cylinder unit to effect respective movements thereof, with each piston-cylinder unit including a longitudinal piston having a first end and a second free end remote from said first end, and each piston-cylinder unit including a longitudinal cylinder, with said first piston end being operatively connected to said longitudinal cylinder, and wherein the longitudinal and central axes of said piston and said cylinder extend substantially coaxially with respect to one another to form a piston-cylinder longitudinal and central axis;

for each second support leg at least one carrier arm pivotally mounted such that the associated second support leg can be swung with respect to said base frame;

means for pivotally connecting a second support leg to its carrier arm, said means forming a first point of reference, and said means allowing turning movements of its second support leg with respect to said first point, and wherein said second support leg is telescopically extensible in length with reference to said first point along its longitudinal central axis;

means for pivotally connecting the respective piston-cylinder unit of the second support leg to its carrier arm, said means forming a second point of reference, and said means allowing turning movements of the piston-cylinder unit with respect to said second point, whereby said first point and said second point are spaced from each other by a fixed distance;

at least one connector, said connector being secured to the associated second support leg in such a way as to be capable of being moved therewith during the respective telescoping extension movement thereof, for connecting said connector and the respective free piston end at a third point of reference which is remote from the respective first point but located on the longitudinal and central axis of its piston-cylinder unit, whereby on actuation of the piston-cylinder unit said at least one connector is adapted to move its second support leg between the rest position and the operating position thereof;

a connecting plate secured to a respective second support leg at least near its second point of reference, said connecting plate having an opening which is in alignment with an opening of the respective carrier arm at least when the second support leg is in its operating position; and a lock pin, said lock pin being insertable in said opening of said connecting plate and in the opening of the associated carrier arm, said lock pin being adapted to connect said connecting plate to the carrier arm, and to prevent swinging movement of the second support leg with respect to said second point of reference as well as to prevent swinging movement of the respective piston-cylinder unit with respect to the respective first point of reference, but allowing a precise alignment of the second support leg, said lock pin being removable from said openings for releasing said connecting plate to allow respective swinging movements of the respective second support leg and its piston-cylinder unit with respect to said first point and said second point as aforesaid on actuation of the piston-cylinder unit, said lock pin being adapted to be inserted into said fixed opening of the second support leg for preventing the telescoping extension thereof.

* * * * *